United States Patent [19]

Mencacci et al.

[11] 3,978,900

[45] *Sept. 7, 1976

[54] CARBONATED BEVERAGE FILLER

[75] Inventors: Samuel A. Mencacci, Saratoga; Gary O. Niemann, Mountain View, both of Calif.

[73] Assignee: FMC Corporation, San Jose, Calif.

[ * ] Notice: The portion of the term of this patent subsequent to Dec. 18, 1990, has been disclaimed.

[22] Filed: Dec. 17, 1973

[21] Appl. No.: 425,587

[52] U.S. Cl. ..... 141/11; 141/172; 141/374; 222/1; 222/451

[51] Int. Cl.[2] ..... B65B 3/04

[58] Field of Search ..... 222/397, 398, 450, 512; 251/332; 141/4–8, 11, 69, 172, 250, 270, 275, 283, 284, 287, 374, 392

[56] References Cited

UNITED STATES PATENTS

| | | | |
|---|---|---|---|
| 2,485,092 | 10/1949 | Gannon | 251/332 |
| 2,521,314 | 9/1950 | Therolf | 251/332 |
| 2,913,016 | 11/1959 | Luther | 141/7 |
| 3,568,734 | 3/1971 | Vadas et al. | 141/89 |
| 3,683,976 | 8/1972 | Remane | 141/287 |
| 3,779,292 | 12/1973 | Mencacci | 141/11 |

*Primary Examiner*—Richard E. Aegerter
*Assistant Examiner*—Richard R. Stearns
*Attorney, Agent, or Firm*—F. W. Anderson; C. E. Tripp; R. S. Kelly

[57] ABSTRACT

A filling apparatus for carbonated beverages including a filling valve connected to a beverage source under pressure and including a measuring cylinder movable into and out of a container to be filled. The measuring cylinder has a foot valve on its lower end and is telescopically associated with an inlet valve. The measuring cylinder defines a chamber between the foot valve and the inlet valve. The measuring cylinder is filled with a predetermined amount of beverage at superatmospheric pressure by moving the cylinder down into an empty container when the foot valve is closed and the inlet valve is open. The inlet valve is then closed. The cylinder and foot valve can then be moved down a slight amount or the foot valve can be moved down a slight amount relative to the cylinder while retaining sealing contact with the cylinder to increase the volume in the chamber thus reducing the pressure of the measured volume of beverage to atmospheric pressure. The foot valve is then opened and the measuring cylinder and foot valve are moved upwardly to transfer the measured quantity of beverage into the container at atmospheric pressure. At the end of the filling cycle, the foot valve is brought into engagement with the inlet valve so that the volume of the chamber is reduced substantially to zero and all of said measured volume of beverage is discharged into the container.

8 Claims, 21 Drawing Figures

FIG_1
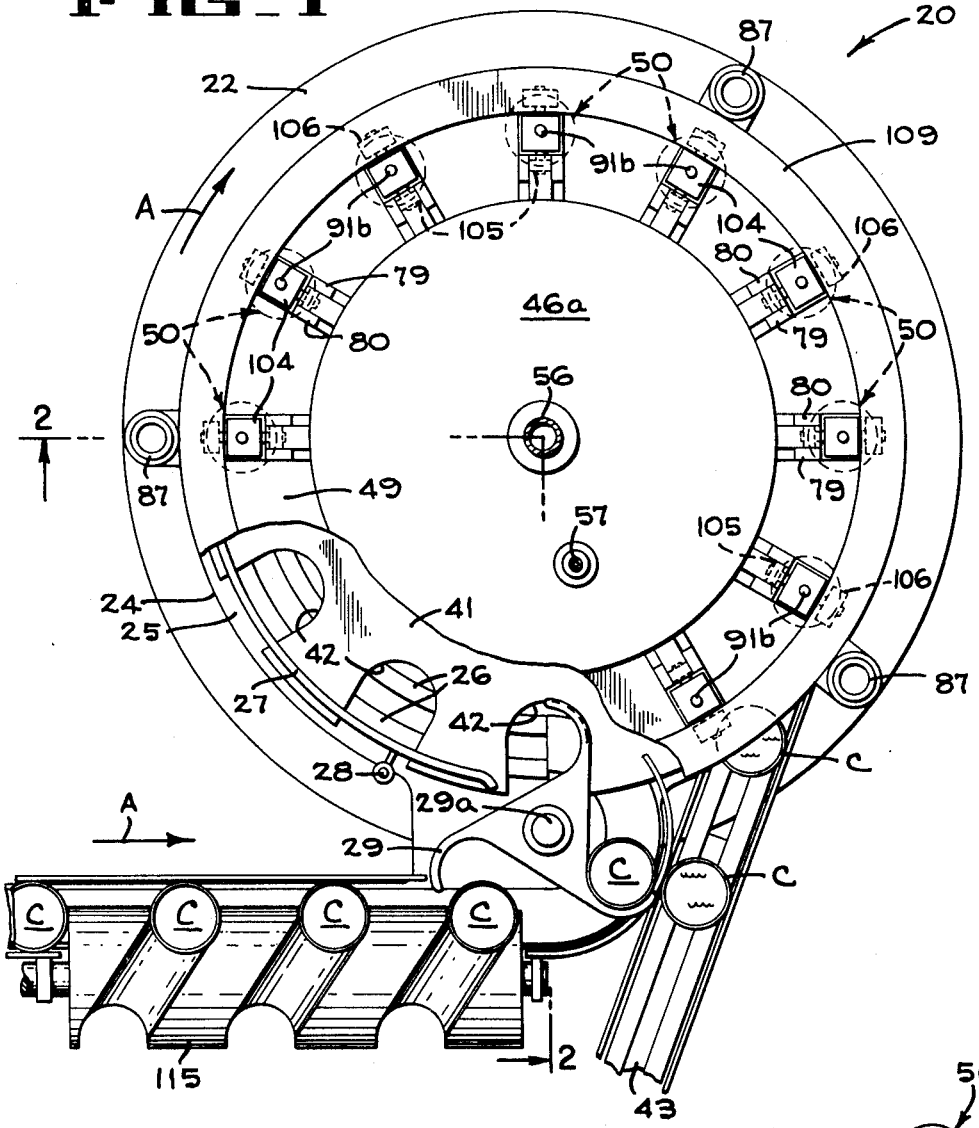
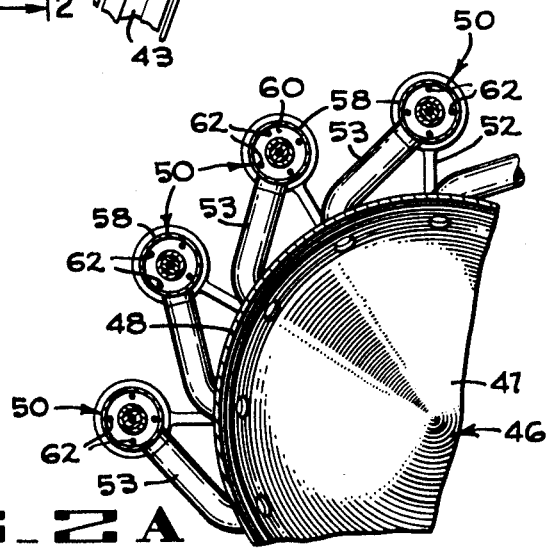
FIG_2A 46a
56
57
105
104
106
108
20
106
108
104
105
83
97
100
98
99
82
48
90b
79
76
80
84
65
78
63
47
49
62
2A
2A
46
53
73
53
58
52
90
60
50
27
C
28
91
41
42
26
25
87
24
22
80
91b
83
97
98
99
100
82
76
78
84
79
73
65
63
49
59
90b
50
62
58
90
60
90a
91a
C
C
29
42
26
25
43
23
37
29a
31
40
38
32
39
33

FIG_3
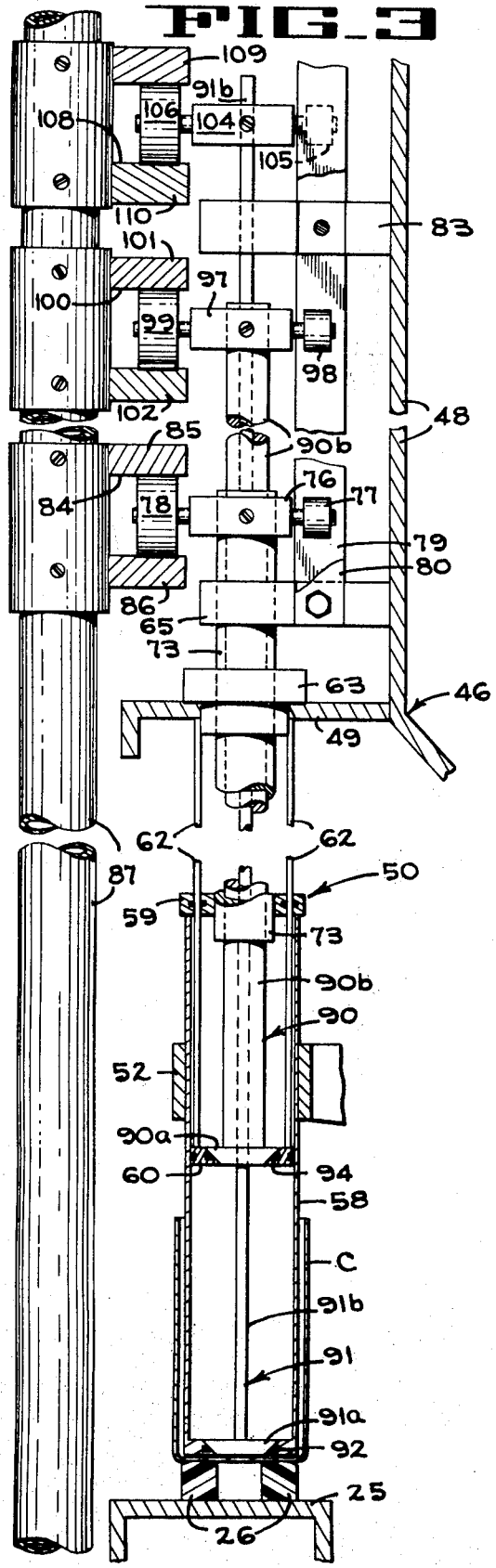
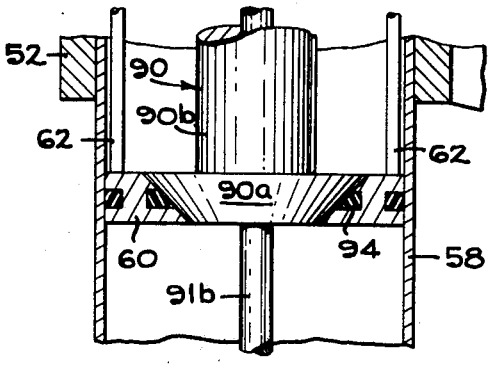
FIG_4
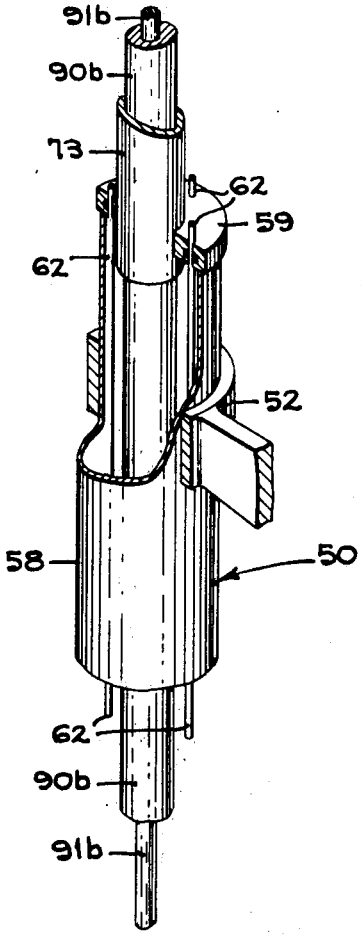
FIG_5

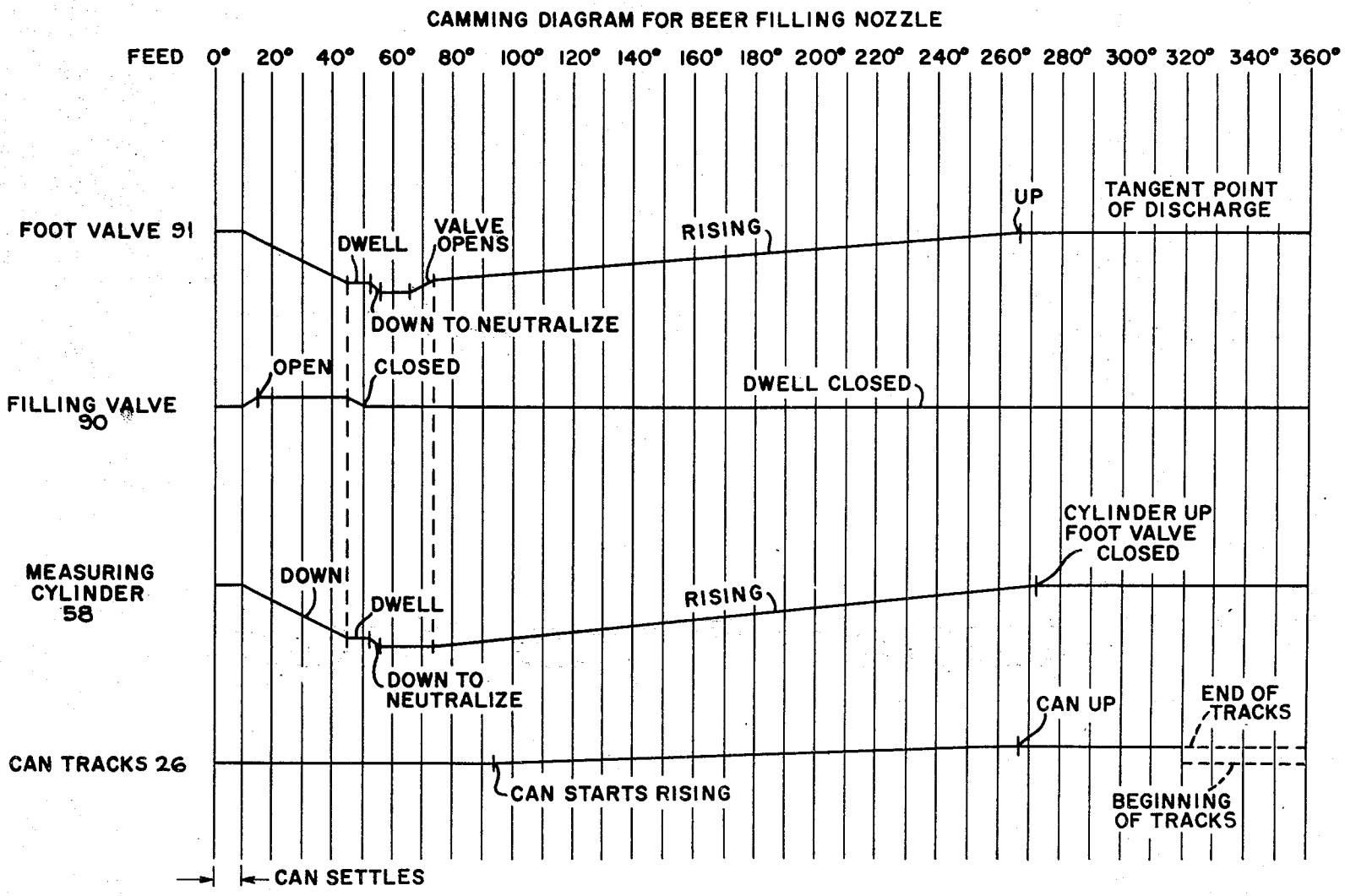
FIG. 12
CAMMING DIAGRAM FOR BEER FILLING NOZZLE
FEED
0° 20° 40° 60° 80° 100° 120° 140° 160° 180° 200° 220° 240° 260° 280° 300° 320° 340° 360°
FOOT VALVE 91
FILLING VALVE 90
MEASURING CYLINDER 58
CAN TRACKS 26
UP
TANGENT POINT OF DISCHARGE
RISING
DWELL
VALVE OPENS
DOWN TO NEUTRALIZE
OPEN
CLOSED
DWELL CLOSED
DOWN
DWELL
DOWN TO NEUTRALIZE
RISING
CYLINDER UP FOOT VALVE CLOSED
CAN UP
CAN STARTS RISING
END OF TRACKS
BEGINNING OF TRACKS
CAN SETTLES FIG_13
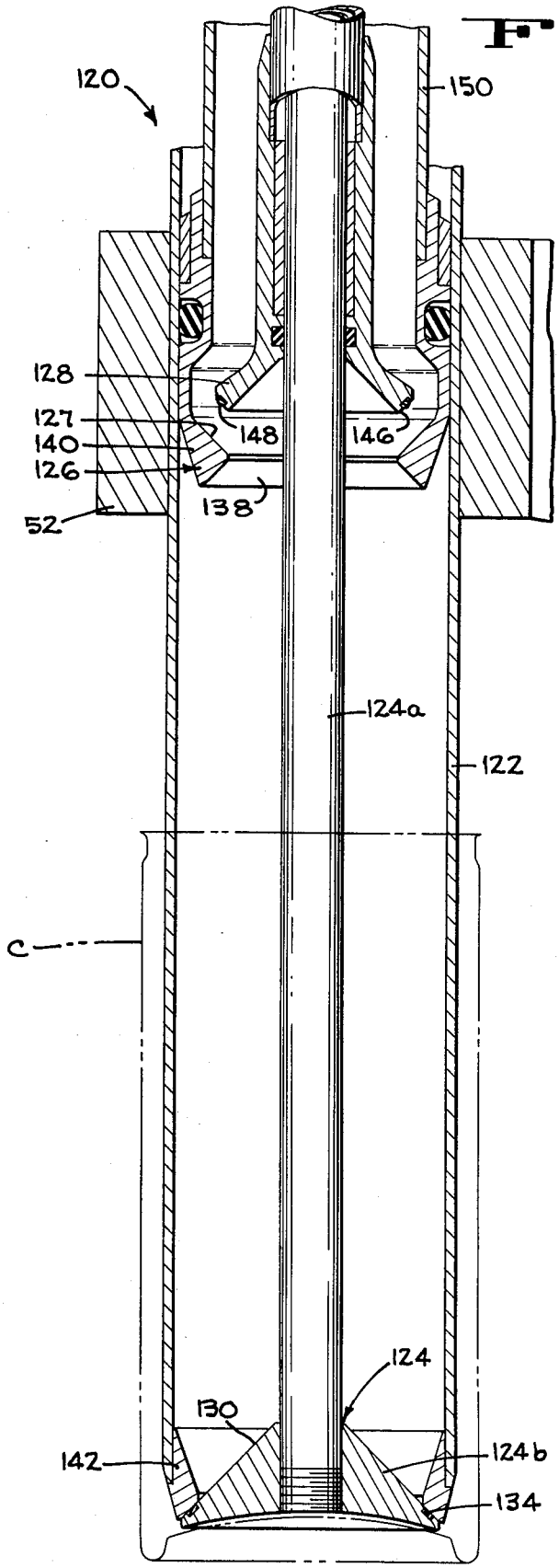
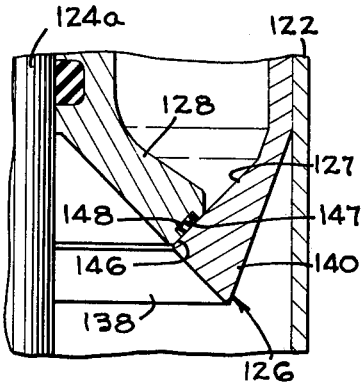
FIG_14
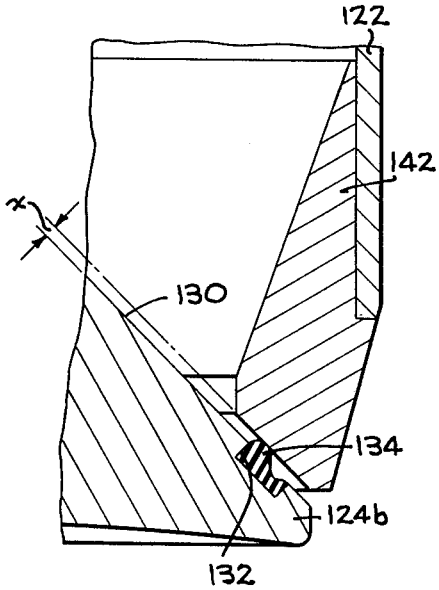
FIG_15

CARBONATED BEVERAGE FILLER

BACKGROUND OF THE INVENTION

1. Field of the Invention

This invention pertains to the beverage filling art and more particularly relates to filling pressurized or carbonated beverages into containers such as lightweight cans, jars, beer mugs or the like.

2. Description of Prior Art

Fillers for filling carbonated beverages such as beer or soft drinks into cans are well known in the art. Most of the prior art fillers discharge the beverage into containers while the beverage is under its super-atmospheric supply pressure of between about 40–15 psi gauge. Thus, the filling valves are provided with resilient can lip seals which engage the upper edge of the cans, and each can must be supported on a can lift table which forces the can upwardly against the seal with a force at least equal to the beverage supply pressure multiplied by the cross sectional area of the container. Such forces are on the order of about 230 pounds when the beverage pressure is 40 psi and a standard 2 11/16th diameter beverage can is being filled. Because of this high sealing pressure, the life of the lip seal is very short, and seal wear which occurs before final seal failure varies the volume of beverage being filled into the cans by leakage past the seal and by inconsistent amounts of bowing of the end of the cans. A further disadvantage of this type of prior art pressure filling apparatus is that the wall thickness of the cans must be relatively thick to withstand the high sealing pressure and thus the cost of the containers are unnecessarily high. Another disadvantage is that the carbonated liquid which is directed into the container is directed in and runs down the walls of the containers at relatively high speed causing a "scrubbing" action which tends to release the carbon dioxide from the liquid providing objectionable foaming of the liquid. Also, air within the empty containers is discharged into the headspace of the supply tank resulting in an undesirable mixture of air and carbon dioxide in the headspace of the tank. Furthermore, each filling valve must be provided with a snifter valve to bleed air and carbon dioxide from the container headspace before the container is released from the lip seal.

Carbonated beverage filling machines which use a "bottom filling" concept have been proposed previously as shown by the disclosure of U.S. Pat. No. 2,144,628 to Hothersall for example. In the machine disclosed in this patent, a measuring cylinder which includes a foot valve at its lower end is arranged to be filled with a carbonated beverage, such as beer, from a reservoir. The cylinder is then lowered into a container to the bottom thereof and the foot valve is opened to allow the beverage to flow into the container. The cylinder is raised as the beverage flows out until the container is filled as the cylinder is raised out of the container. In order to prevent the foaming of the beverage during filling, the measuring cylinder is vented to the atmosphere. However, such a provision causes difficulties in providing an exact predetermined amount of beverage during each filling cycle and also results in the possibility of spilling a portion of the beverage out of the measuring cylinder through the vent passage.

SUMMARY OF THE INVENTION

In accordance with the present invention the beverage is filled into the container at substantially atmospheric pressure. For this purpose, each filling valve includes a measuring cylinder having a foot valve and an inlet valve that are relatively movable. The valves and cylinder define a collapsible measuring chamber which, when the valves are spaced a predetermined distance apart, confines the predetermined quantity of liquid therein at the supply pressure and at a temperature slightly above 32°F. At or just prior to the opening of the foot valve to release the beverage into the container the volume of the measuring chamber is increased slightly to reduce the pressure therein to a pressure that is substantially equal to atmospheric pressure.

After the foot valve is opened, the foot valve and measuring cylinder are moved toward the inlet valve and the surrounding piston structure to thereby allow the liquid beverage to be discharged from the measuring cylinder into the container. As the foot valve and cylinder are being relatively moved toward the piston and closed inlet valve, the container and the piston-inlet valve structure are also gradually moved towards each other but at a slower rate than the rate of movement of the cylinder with respect to the container thereby allowing the foot valve to remain below the level of the liquid in the container at all times during filling except upon initial opening of the foot valve while permitting the foot valve to closely follow the liquid level as it rises in the container. At the conclusion of the filling cycle, the foot valve is brought into engagement with the piston and inlet valve structure in order to displace all or substantially all of the liquid in the measuring cylinder. Accordingly, foaming will be greatly minimized since there is very little opportunity for air to mix with the liquid. Also, foaming due to "scrubbing" of the carbon dioxide containing liquid will be minimized since the velocity of the liquid relative to the container walls is reduced to a minimum. It will also be noted that the air within the container is bled directly to the atmosphere and not into the headspace of the supply tank as in certain of the aforedescribed prior art devices.

Since the open upper end of the container is not subjected to any sealing pressures during filling, the walls of the container may be quite thin since no pressure resisting forces, except that required to resist the forces of applying covers to the containers, are required. Also, because the containers are filled at atmospheric pressure, rather than at superatmospheric pressure as in certain of the aforedescribed prior art devices, uncontrollable bowing of the end walls of the containers is not a problem.

It is therefore one object of the present invention to provide a method and an apparatus for filling containers with a gas containing liquid such as a carbonated liquid at atmospheric pressure.

Another object is to provide a carbonated beverage filler capable of filling light weight thin walled containers.

Another object is to provide a carbonated beverage filler wherein headspace gases from the containers being filled are discharged directly to the atmosphere without contaminating the gas or liquid in the beverage supply tank.

Another object is to provide a more accurate method and apparatus for filling carbonated liquids into containers.

BRIEF DESCRIPTION OF THE DRAWINGS

FIG. 1 is a diagrammatic plan with parts broken away of one embodiment of the carbonated beverage filler of the present invention.

FIG. 2A is a horizontal section taken along lines 2A—2A of FIG. 2 illustrating the flexible hoses for connecting the beverage supply tank to the several filling valves.

FIG. 3 is an enlarged diagrammatic vertical section taken through one of the valves of the FIG. 1 embodiment of the present invention and its operating mechanism.

FIG. 4 is an enlarged central section taken through one of the inlet valves of the FIG. 1 embodiment of the beverage filler of the present invention.

FIG. 5 is a perspective of a portion of one of the measuring cylinders of the FIG. 1 embodiment of the beverage filler of the present invention.

FIG. 12 is a cam diagram illustrating the sequence of operation of the several components of each filling valve of the FIG. 1 embodiment of the beverage filler of the present invention.

FIG. 13 is a vertical section through the measuring cylinder and valving structure of a second embodiment of the carbonated beverage filler of the present invention.

FIG. 14 is an enlarged fragmentary section through a portion of the inlet valve and piston structure of the beverage filler of FIG. 13 but showing an inlet valve in its closed position.

FIG. 15 is an enlarged fragmentary section through a portion of the foot valve and cylinder structure of the beverage filler of FIG. 13 but showing the foot valve in a partially open position to allow expansion of the measuring chamber without losing the seal at the foot valve.

DESCRIPTION OF THE PREFERRED EMBODIMENTS

Figure 2:
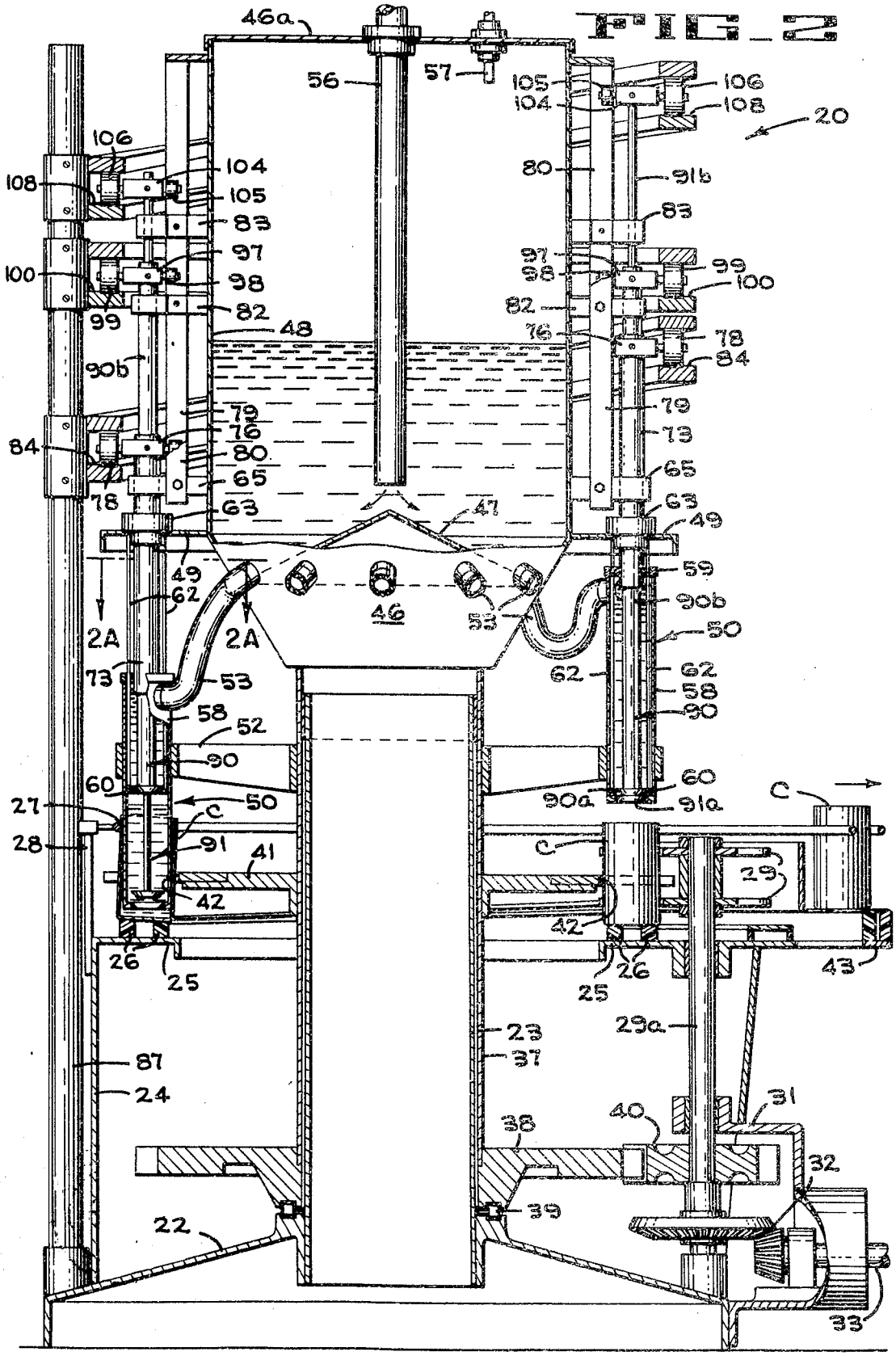
FIG. 2 is a vertical section taken along lines 2—2 of FIG. 1.

In FIGS. 1 and 2 the reference numeral 20 indicates generally an embodiment of the filling machine of the present invention which includes a stationary base 22 that supports a stationary tubular center post 23. The base also supports an outer wall member 24 that has, extending around the major portion of its upper edge, an inwardly projecting rim 25 on which a pair of circular container support tracks 26 are mounted. A guide rail 27, which is supported from three fixed standards 28 projecting upwardly from the side of the outer wall member 24, retains containers C on the platform as they are moved in a circular path. The containers C, which may be jars, metal cans or the like, are fed onto the platform by a star wheel 29 that is keyed to a shaft **29*a*. As seen in FIG. 2, the shaft 29*a* is journalled near its upper end in a bushing carried by the rim 25, and near its lower end, in a bushing carried in a bracket 31 and another bushing carried by the base 22. The shaft 29*a* and the star wheel attached thereto are driven at a speed up to about 1500 cans per minute through a bevel gear set 32 from a drive shaft 33** that is adapted to be driven continuously.

A tubular post 37, which surrounds the center post 23, is secured at its lower end to a large gear 38 that also surrounds center post 23 and is supported for rotation on the base 22 by an anti-friction bearing ring 39. The gear 38 is in mesh with a pinion 40 that is keyed to shaft **29*a*.**

About halfway up from its lower end, the post 37 has a pusher ring 41 secured thereto as by setscrews. At its outer periphery the ring 41 is provided with twelve equi-angularly spaced pockets 42 (FIG. 1) that receive containers from the star wheel 29 and subsequently discharge them onto chute 43 leading to a conventional take-away conveyor.

At its upper end, the tubular post 37 carries a supply tank or reservoir 46 having a cover **46*a* thereon for maintaining liquid that is to be filled into the containers C under superatmospheric pressure. The reservoir is a heavy sheet metal member that has a conical base wall 47 and a cylindrical outer wall 48. A short outwardly extending flanged platform 49 is rigid with the outer wall 48 and suppports a plurality of filler valves 50. Each filler valve 50 is guided for vertical reciprocal movement by a spider 52 and is connected to the reservoir by flexible resilient conduits 53 that extend tangentially from the reservoir 46 as indicated in FIG. 2A. Liquid is supplied to the reservoir by a central overhead supply conduit 56 and carbon dioxide is supplied through a conduit 57,** preferably at a superatmospheric pressure of between about 15–40 psig.

In the embodiment of FIG. 1 there are twelve valve assemblies 50 positioned in equi-angularly spaced relation around the outer portion of the reservoir. Only nine valves are shown in FIG. 1. The valves are identical and, as seen in FIG. 3, each valve includes a measuring cylinder 58 that is guided for vertical movement in an annular passage in the spider 52. The measuring chamber cylinder 58 (FIG. 4) includes a cylinder head 59 and is also vertically movable relative to an annular valve seat or piston 60 that is suspended by four rods 62 (two only being shown in FIG. 3). The rods 62 are fixed to and depend from a vertically adjustable collar 63 which is normally secured in adjusted position to the platform 49. The rods 62 are also slidably received in and sealed by O-rings to the cylinder head 59. As seen in FIG. 4, a conventional rubber seal ring is disposed in the outer periphery of the valve seat or piston 60 to maintain a sealing contact with the measuring cylinder 58 as it moves vertically relative to the valve seat 60.

Vertical movement of the measuring cylinder 58 is effected by a tube 73 (FIG. 3) which is connected to the cylinder head 59 and is guided for vertical movement in the collar 63 and in a bracket 65 secured to a vertical cylindrical wall 48 of the reservoir. A collar 76, which is secured to the upper end of the tube 73, carries a guide roller 77 at one side and a cam follower roller 78 at the other side. The guide roller 77 travels in a vertical slot defined by spaced vertical tracks 79 and 80 that are supported by the lower bracket 65 and by upper brackets 82 and 83. The cam follower 78 travels in a cam track 84 defined between upper and lower plates 85 and 86 that are secured to three fixed tubular standards 87 projecting upwardly from the base 22. It will be apparent that, as the reservoir is rotated about its central axis, all of the filling valves are moved in a circular path, and the cam follower 78 associated with each valve travels in the cam track 84 and reciprocates the measuring cylinder vertically. The contour of the cam track 84 will be discussed hereinafter.

Each valve assembly 50 also includes an inlet valve 90 and a foot valve 91. The inlet valve 90 comprises a valve member 90*a*, that is adapted to engage a seal ring 94 (FIG. 4) carried in the piston or valve seat 60, and a lifting tube 90*b* that is slidably journaled in the tube 73. The tube 90*b* is reciprocated vertically by means of a collar 97 that is secured to the tube 90*b* and carries a guide roller 98 and a cam follower roller 99. The guide roller is disposed in the track between plates 79 and 80, and the follower 99 travels along a cam track 100 defined by members 101 and 102.

The foot valve 91 includes a valve member 91*a* (FIG. 3), that seats on a seal ring 92 in the lower end of cylinder 58, and a lift rod 91*b* that is slidably journaled in the tube 90*b*. A collar 104, which is secured to the upper end portion of rod 91*b*, carries a guide roller 105 and a cam follower roller 106. The guide roller 105 is disposed in the slot between plates 79 and 80, and the follower 106 travels in a cam track 108 defined by members 109 and 110.

Referring to FIG. 1, it will be noted that the containers C are advanced in the direction of arrow A by a feed screw 115 which delivers them to the star wheel 29. The star wheel rotates in a counterclockwise direction and moves each container into a separate pocket 42 of the pusher ring 41 which travels clockwise. The container C is fully in the pocket 42 and directly below a valve 50 when it reaches the position indicated by the zero degree radial line position (FIG. 12). Since the lower wall of the reservoir and the valve supporting flange 49 in effect constitute a turret which carries the valves 50 in a circular path, the reservoir will be referred to as a turret hereinafter to coordinate the movements of the valve elements with their circular movement.

Figure 6:
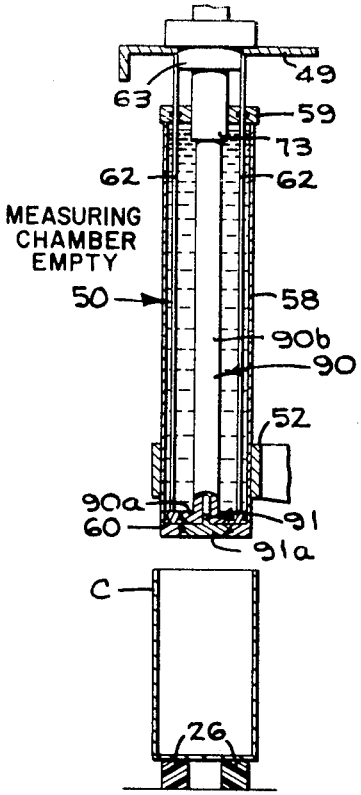
FIGS. 6–11 are operational views in vertical section of the FIG. 1 embodiment of the present invention illustrating progressive steps in the container filling operation.

The major operations of each valve 50 as it and the container C therebelow travel in a clockwise path with the turret are indicated in FIGS. 6–11. In addition, FIG. 12 indicates graphically the movements of the various elements. FIG. 6 illustrates the position of the members at the zero degree entry position. The foot valve 91*a* is closed; the inlet valve 90*a* is closed; and the measuring cylinder 58 is in its raised position.

For the first 10° of rotation the valves and the cylinder are held in the FIG. 6 position, allowing the containers C to become fully oriented under the valve 50. At about the 10° position of the turret the measuring cylinder 58 and the foot valve 91*a* are moved downwardly as a unit, the valve 91*a* remaining on its seat. Also, at the 10° position, the inlet valve 90*a* is moved upwardly off its seat to permit liquid to flow into the cylinder 58 as it moves downwardly.

Figure 7:
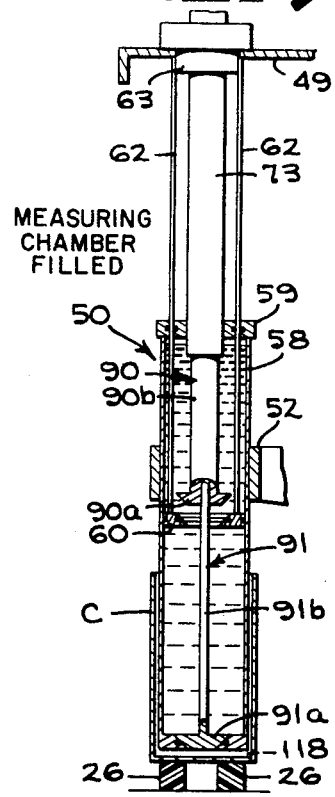

At about the 45° position the unitary downward movement of the measuring chamber 58 and the foot valve 91*a* is stopped as shown in FIG. 7. During the next five degrees of rotation, the inlet valve 90*a* is moved downwardly to closed position to trap a predetermined charge of liquid in the measuring chamber.

Figure 8:
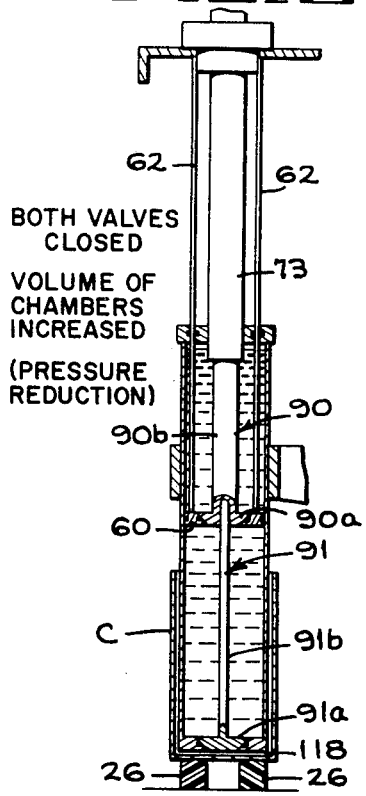

After the valve 90*a* is closed, the measuring chamber 58 and the foot valve 91*a* are again lowered by a very small amount of about 0.001 to 0.003 of an inch to a position close to, but spaced slightly above, the bottom of the container as indicated at 118 in FIGS. 7 and 8. The second downward movement of the cylinder and foot valve is initiated at about the 52° position and is completed during about 3° of rotation of the turret. This second downward movement of the cylinder and foot valve causes a slight increase in the volume of the measuring chamber 58. As a result the initial pressure in the cylinder, which may be substantially equal to the equalizing pressure of the dissolved gas in the liquid at a specific temperature plus the hydrostatic head of the liquid in the measuring chamber and reservoir plus any overriding gas pressure in the reservoir, is reduced substantially to atmospheric pressure. As mentioned previously, the overriding pressure is conventionally in the order of 15–40 psig.

Figure 9:
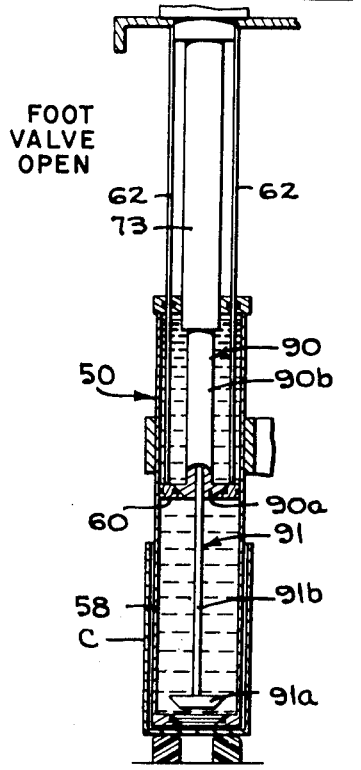
Figure 10:
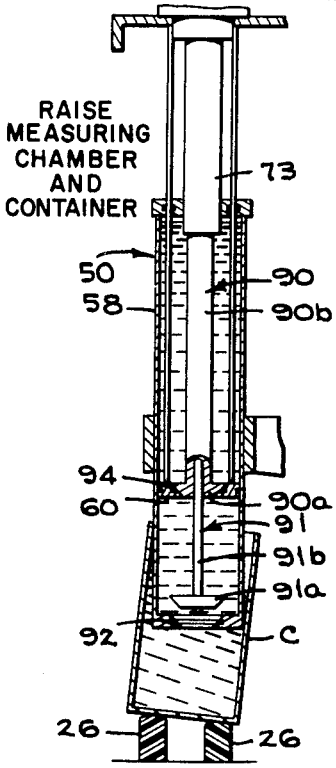
Figure 11:
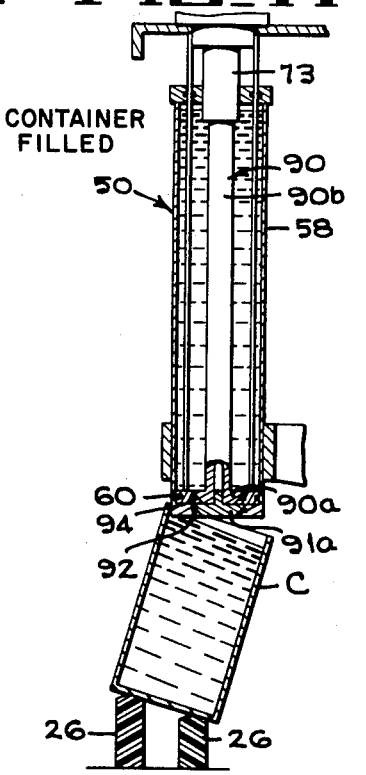

After the pressure is reduced, the foot valve 91*a* is moved upwardly toward the open position of FIG. 9, the opening movement starting at about the 65° position and being completed at the 75° position. At this position, the measuring cylinder and the open foot valve are moved upwardly as a unit. As the cylinder is elevated, liquid flows into the container as indicated in FIG. 10. When the 272° position is reached, the cylinder has been completely emptied, and the foot valve has been tightly closed on its seat 92. Also it should be noted that the foot valve 91 and its seat 92 will have been brought into engagement with the piston 60 and the inlet valve 90 (as shown in FIG. 11) so that the volume of the measuring chamber has been reduced to zero or substantially to zero. This assures that there will be no entrapped air in the measuring chamber during subsequent filling cycles which may affect the filling process or the amount of beverage which is discharged into the chamber.

It will be noted in FIGS. 6 to 11 that the support tracks 26 on which the container rides are relatively low up until the FIG. 9 position is reached. Thereafter, starting at about the 94° position of the turret, the height of the tracks is increased to gradually elevate the container during the container filling period. Thus, the container and the piston 60 are moved toward each other during the filling operation to force the beverage out of the cylinder and maintain the lower end of the cylinder always beneath the level of the fluid in the container during the entire filling sequence. This prevents the entry of air into the measuring chamber during the filling process. Also, the innermost track is of less height than the outermost track to hold the container in a tilted position to counteract the effect of centrifugal force on the liquid in the container.

At about the 292° position of the turret the FIG. 11 position is reached and the filled container is moved into the downwardly inclined tangential discharge chute 43.

In FIG. 13 there is shown a second embodiment 120 of a filler valve which also includes the concepts of the present invention and which may be incorporated into a beverage filling machine similar to the machine 20 disclosed in FIGS. 1–12. The filler valve 120 includes component parts similar to those of the aforedescribed filler valve 50 including a cylinder 122 which is arranged to be lowered down into a container C (FIG. 13) and which defines the variable volume measuring chamber in which the predetermined charge of liquid to be filled into the container is measured, a foot valve 124 for closing the lower end of the cylinder, a piston 126 defining the upper end of the measuring chamber within the cylinder, and an inlet valve 128 which is adapted to seat upon an inner annular frusto-conical face segment 127 (FIG. 14) of the piston to seal the beverage reservoir from the measuring chamber.

The foot valve 124 is comprised of an axially extending lift rod 124*a* and a conical plug element 124*b* at the lower end of the lift rod which elements are similar to the elements 91*b* and 91*a*, respectively, of the foot valve 91 of the embodiment of the invention disclosed in FIGS. 1–12. The outwardly extending frusto-conical face 130 of the plug member 124*b* is provided with, near the lower annular end thereof, a shallow annular groove 132 in which there is received a resilient sealing ring 134. As shown in FIG. 15, when the foot valve and cylinder are separated slightly, the resilient sealing ring 134 may expand and still maintain sealing contact between the cylinder and foot valve.

Figures 17, 18, 19, 20:
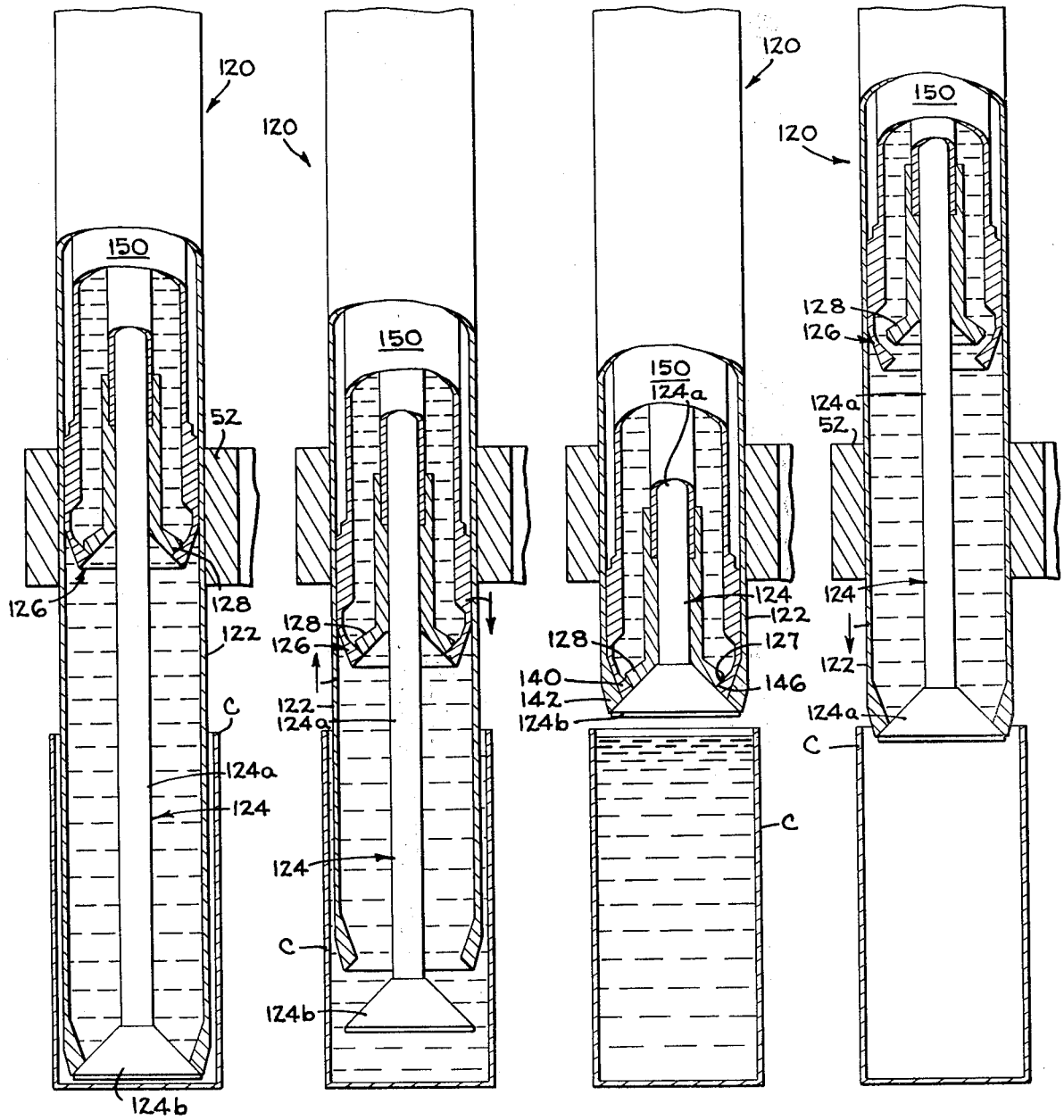
FIGS. 17–20 are operational views in vertical section of the FIG. 13 embodiment of the present invention illustrating progressive steps in the container filling operation.

The piston 126 includes an annular end surface 138 which is adapted to seat against the conical surface 130 of the foot valve 124 when the piston and foot valve are brought into engagement as shown, for example, in FIG. 19. Piston 126 also includes a generally conical segment 140 which is adapted to seat against and engage an inwardly extending conical segment 142 of the lower end of the cylinder 122 when the cylinder and piston are brought into engagement (FIG. 19). Segment 142 includes the inwardly extending annular face 127 which is adapted to provide a seat for the outer annular face 146 of the inlet valve 128. This annular face 146, as shown in FIG. 14, is provided with an annular groove 147 which receives an annular resilient sealing element 148 for sealing the beverage reservoir from the measuring chamber when the inlet valve is seated upon the piston.

With the exception of the piston 126, the operative components of the filler valve 120 are mounted on an overhead camming structure for relative movement in a manner similar to that disclosed for the operative components of the filler valve 50 in the embodiment of the invention disclosed in FIGS. 1–12. The specific relative movements of the various components in the filler valve 120 are, however, slightly different from those of filler valve 50 as will be explained in greater detail hereinafter. In the operation of filler valve 50, the piston remained stationary during the filling operation while the container was elevated. In filler valve 120, as shown in FIG. 13, the piston 126 is arranged to be moved vertically relative to the fixed frame structure including the bearing portion of the spider 52 which encompasses the cylinder 128. For this purpose, the piston is connected to a vertically extending cylindrical sleeve 150 which may be connected to a suitable cam follower structure that is mounted upon a cam track in a manner generally similar to the manner in which the cam followers 78, 99 and 106 are connected to their respective operative elements in the filler valve 50.

Figure 16:
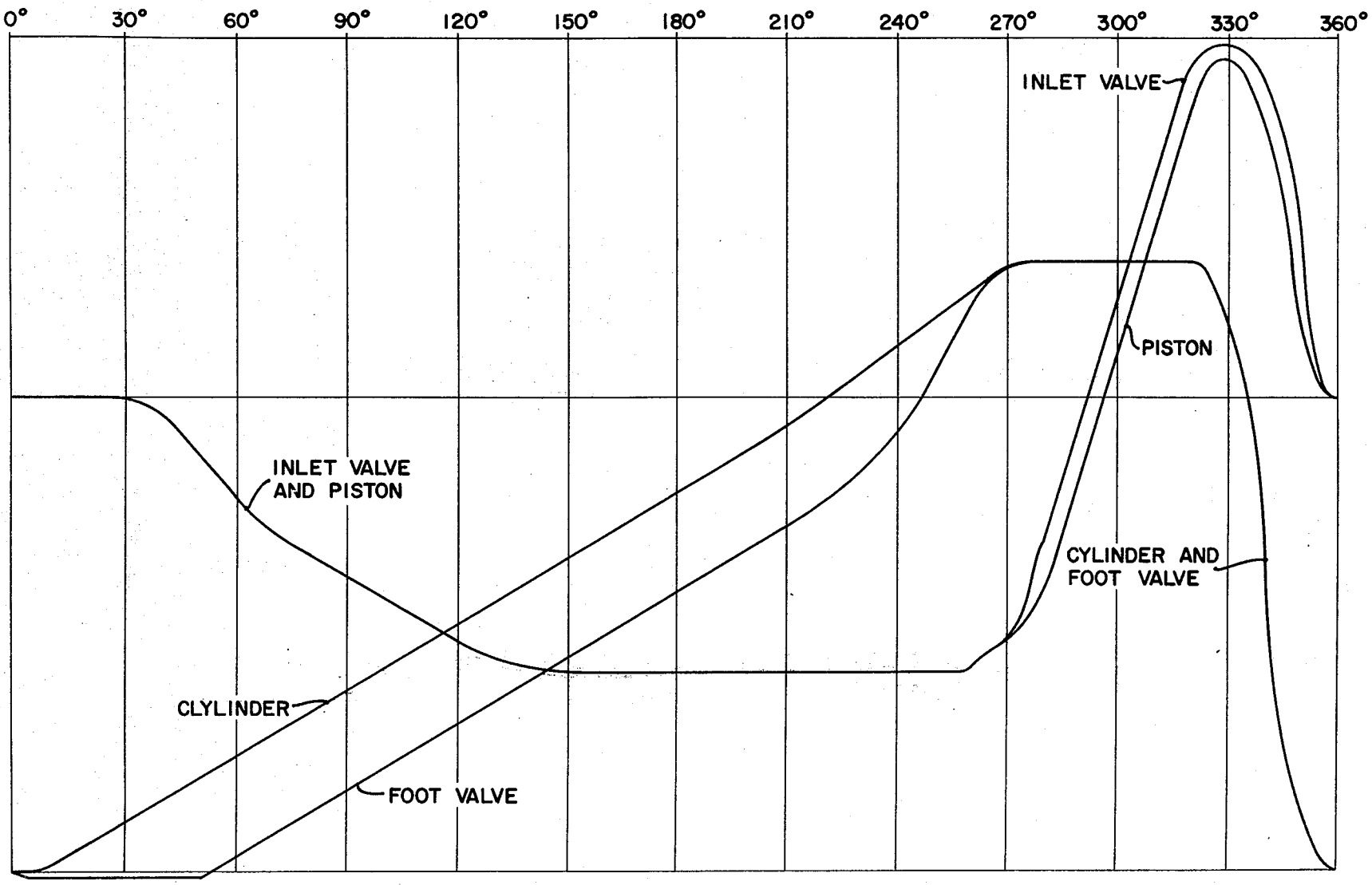
FIG. 16 is a timing diagram illustrating the relative sequence of operation of the various components of the valving structure of the FIG. 13 embodiment of the beverage filler of the present invention.

The operation of the filler valve 120, as shown in FIGS. 17–20 and as diagrammatically illustrated in the timing diagram of FIG. 16, is generally similar to the operation of the aforedescribed filler valve 50. In the indicated zero degree (FIG. 16) position the cylinder 122 has been lowered into the container C to a position just slightly above the bottom thereof and is at rest. The inlet valve 128 is closed to prevent the entry of any further fluid into the measuring chamber. This position is diagrammatically illustrated in FIG. 17. At this time the fluid in the measuring chamber is at the same superatmospheric pressure as the fluid in the reservoir. During the next approximately 5° of rotation of the turret carrying the filler valve 120, the foot valve 124 is lowered by a very small amount until the resilient sealing ring 134 loses sealing contact with the lower end of the cylinder 122 and allows the liquid to flow out of the measuring chamber and into the container C. Just prior to this, however, as shown in FIG. 15, the measuring chamber will have been expanded by an amount equal to the volume contained in the frusto-conical segment defined by the thickness $x$ which has been provided during the initial lowering of the foot valve with all other components of the filler valve remaining stationary. This expansion of the measuring chamber reduces the pressure of the liquid to approximately atmospheric pressure so that spurting and foaming do not occur during the subsequent discharge of the beverage into the container.

Shortly after the foot valve is lowered to break the seal, the cylinder is moved upwardly to open the gap between the foot valve and cylinder and allow the liquid to flow readily from the measuring chamber. As the product starts to flow up along the sides of the cylinder, the foot valve is also elevated so that the foot valve and cylinder travel upwardly together through the major portion of the operating cycle while the liquid is being filled into the container. In order that the foot valve will remain below the surface of the liquid in the container as it is being filled, the piston is moved downwardly relative to the can during the upward travel of the foot valve and cylinder so that the beverage will be displaced from the measuring chamber in the proper manner. FIG. 18 shows the position of the filler valve components at about the 90° position of turret rotation where the piston and inlet valve (which are in engagement) are moving downwardly together while the open foot valve and cylinder are being raised.

The container continues to fill until about the 250° position of turret rotation when all of the liquid in the measuring chamber will have been discharged. The foot valve and cylinder are then raised up out of the liquid and are brought together into sealing engagement with the piston and inlet valve, at about the 270° rotative position, as shown in FIG. 19. In the FIG. 19 position, it will be noted that the volume of the measuring chamber has been reduced to substantially zero. It is important that this volume be small as possible — allowing for machine tolerances and rounded corners, etc. — so that any air entrapped within the measuring chamber at the conclusion of the discharge stroke (270°) will be a minimum and not significantly affect the subsequent container filling operation or the amount of beverage filled into the container during such subsequent filling operation.

From the 270° rotative position to the 360° rotative position, the inlet valve and piston are separated and are elevated to re-establish the measuring chamber and to fill it with a predetermined quantity of liquid from the reservoir. At about the 330° position, as shown in FIG. 20, the inlet valve and piston reach the maximum height of their stroke, and the closed foot valve and cylinder have begun to be lowered into the container. The charging of the measuring chamber continues as the cylinder is lowered into the container until the cylinder reaches a position just above the bottom thereof at the 360° (or 0°) rotative position. The aforedescribed operating sequence is then ready to be repeated.

Although a multiple valve beverage filler has been illustrated, it is to be understood that the invention is to be construed broadly enough to cover a single manually operated beverage filler of the type used to fill glasses or mugs at a refreshment stand.

From the foregoing description it is apparent that the carbonated beverage filler of the present invention is operable to confine a measured quantity of carbonated liquid in a measuring chamber, to reduce the pressure of the confined liquid by increasing the size of the chamber, and to dispense the measured quantity of liquid into a container at atmospheric pressure. At the conclusion of each filling operation the volume of the measuring chamber is reduced to zero so that an exact predetermined amount of beverage will be filled into each container.

Although the best mode contemplated for carrying out the present invention has been herein shown and described, it will be apparent that modification and variation may be made without departing from what is regarded to be the subject matter of the invention.

What is claimed is:

1. An apparatus for filling a carbonated liquid into a container comprising, supply means for maintaining a supply of carbonated liquid under superatmospheric pressure, means defining a variable volume measuring chamber for receiving and confining a predetermined quantity of liquid at said superatmospheric pressure from said supply means, foot valve means for releasing the liquid from the measuring chamber into a container at atmospheric pressure, said foot valve means including an expansible resilient sealing element for sealing between said foot valve means and said chamber defining means, and means for slightly increasing the volume of said chamber defining means for reducing the pressure of said liquid to about atmospheric pressure, said last named means comprising means for lowering said foot valve means slightly with respect to said chamber defining means to permit said sealing element to be moved vertically while still maintaining its sealing effect with said chamber defining means.

2. An apparatus for filling a carbonated liquid into a container according to claim 1 wherein said foot valve includes a frusto-conical plug member, said sealing element being located on the upwardly extending conical surface of the plug member.

3. An apparatus according to claim 1 and additionally comprising means for lowering the measuring chamber into the container during confinement of the measured quantity of liquid, and means for raising the measuring chamber from the container during the release of the liquid into the container.

4. An apparatus for filling a carbonated liquid into a container comprising supply means for maintaining a supply of carbonated liquid under superatmospheric pressure; a vertically oriented cylinder connected to said supply means; a foot valve for closing the lower end of said cylinder; a piston mounted for relative movement within said cylinder, said piston and foot valve defining a variable volume measuring chamber within said cylinder for measuring a predetermined charge of liquid for delivery to said container; an inlet valve provided in said piston for permitting flow of said liquid from said supply means to said measuring chamber; means for holding a container to be filled in a position to receive said predetermined charge of liquid from said measuring chamber; and raising and lowering means attached to at least three of said container holding means, said cylinder, said foot valve, said piston and said inlet valve for relatively moving said container holding means, said cylinder, said foot valve, said piston and said inlet valve so that said cylinder is lowered into said container and said inlet valve is closed with said predetermined charge of liquid being in said measuring chamber, said foot valve and cylinder are separated to permit said liquid to flow into said container, said cylinder is raised relative to said container while said container is filled with the lower end of said cylinder remaining beneath the surface of the liquid in the container substantially until the completion of the filling thereof, said cylinder and foot valve are closed and are brought into engagement with said piston to reduce the volume of said measuring chamber substantially to zero, and said inlet valve is opened and said piston is separated from said foot valve to recharge the measuring chamber.

5. An apparatus for filling a carbonated liquid into a container according to claim 4 wherein said last named means is operative in a manner so that said piston and closed inlet valve are lowered relative to said container during the filling of said liquid into said container in order to displace the liquid in said measuring chamber at a rate whereby the lower portion of the cylinder will remain below the liquid level in the container during substantially the entire filling thereof.

6. An apparatus for filling a carbonated liquid into a container comprising supply means for maintaining a supply of carbonated liquid under superatmospheric pressure; a vertically oriented cylinder connected to said supply means; a foot valve for closing the lower end of said cylinder; a piston mounted for relative movement within said cylinder, said piston and foot valve defining a variable volume measuring chamber within said cylinder for measuring a predetermined charge of liquid for delivery to said container; an inlet valve provided in said piston for permitting flow of said liquid from said supply means to said measuring chamber; means for holding a container to be filled in a position to receive said predetermined charge of liquid from said measuring chamber; and raising and lowering means attached to at least three of said container holding means, said cylinder, said foot valve, said piston and said inlet valve for relatively moving said container holding means, said cylinder, said foot valve, said piston and said inlet valve so that said cylinder is lowered into said container and said inlet valve is closed with said predetermined charge of liquid being in said measuring chamber, said measuring chamber is expanded slightly after said inlet valve is closed and prior to discharge of liquid from said measuring chamber thereby to reduce the pressure thereof to substantially atmospheric pressure, said foot valve and cylinder are separated to permit said liquid to flow into said container, said cylinder is raised relative to said container while said container is filled with the lower end of said cylinder remaining beneath the surface of the liquid in the container substantially until the completion of the filling thereof, said cylinder and foot valve are closed and are brought into engagement with said piston to reduce the volume of said measuring chamber substantially to zero, and said inlet valve is opened and said piston is separated from said foot valve to recharge the measuring chamber.

7. An apparatus for filling a carbonated liquid into a container comprising supply means for maintaining a supply of carbonated liquid under superatmospheric pressure; a vertically oriented cylinder connected to said supply means; a foot valve for closing the lower end of said cylinder; a piston mounted for relative movement within said cylinder, said piston and foot valve defining a variable volume measuring chamber within said cylinder for measuring a predetermined charge of liquid for delivery to said container; an inlet valve provided in said piston for permitting flow of said liquid from said supply means to said measuring chamber; means for holding a container to be filled in a position to receive said predetermined charge of liquid from said measuring chamber; raising and lowering attached to at least three of said container holding means, said cylinder, said foot valve, said piston and said inlet valve for relatively moving said container holding means, said cylinder, said foot valve, said piston and said inlet valve so that said cylinder is lowered into said container and said inlet valve is closed with said predetermined charge of liquid being in said measuring chamber, said foot valve opens downwardly of the end of said cylinder to permit said liquid to flow into said container, said cylinder is raised relative to said container while said container is filled with the lower end of said cylinder remaining beneath the surface of the liquid in the container substantially until the completion of the filling thereof, said cylinder and foot valve are closed and are brought into engagement with said piston to reduce the volume of said measuring chamber substantially to zero, and said inlet valve is opened and said piston is separated from said foot valve to recharge the measuring chamber; means within said raising and lowering means for expanding said measuring chamber slightly after said inlet valve is closed and prior to the discharge of liquid from said measuring chamber to reduce the pressure thereof to substantially atmospheric pressure; and an expansible resilient sealing element for sealing between said foot valve and said end of said cylinder, said sealing element being capable of expanding during the relative movement of said foot valve away from said cylinder while retaining sealing contact with said foot valve and cylinder for a sufficient amount of relative movement of said foot valve and cylinder in order to permit said pressure of the liquid in the measuring chamber to be reduced to substantially atmospheric pressure.

8. An apparatus according to claim 7 wherein said foot valve includes a frusto-conical plug member, said sealing element being located on the upwardly extending conical surface of said plug member.

* * * * *